US007031228B2

(12) United States Patent
Born et al.

(10) Patent No.: US 7,031,228 B2
(45) Date of Patent: Apr. 18, 2006

(54) TIMEPIECE WITH TOUCH-TYPE READING AND CONTROL OF TIME DATA

(75) Inventors: Jean-Jacques Born, Morges (CH); Erik Jan Frenkel, Neuchatel (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 10/652,503

(22) Filed: Sep. 2, 2003

(65) Prior Publication Data

US 2004/0042347 A1 Mar. 4, 2004

(30) Foreign Application Priority Data

Aug. 30, 2002 (EP) ..... 02078576

(51) Int. Cl.
*G04C 13/00* (2006.01)

(52) U.S. Cl. ..... 368/69; 368/230

(58) Field of Classification Search ..... 368/69–71, 368/230

See application file for complete search history.

(56) References Cited

U.S. PATENT DOCUMENTS 4,228,534 A * 10/1980 Fellrath et al. ..... 368/224
4,257,115 A * 3/1981 Hatuse et al. ..... 368/69
4,369,440 A 1/1983 Piguet et al.
D323,127 S * 1/1992 Kawashima ..... D10/39
5,365,497 A 11/1994 Born
5,453,960 A * 9/1995 Teres et al. ..... 368/69
5,559,761 A 9/1996 Frenkel et al.
5,742,564 A * 4/1998 Kuschel et al. ..... 368/69
6,052,339 A 4/2000 Frenkel et al.
2002/0060953 A1* 5/2002 Farine et al. ..... 368/69

FOREIGN PATENT DOCUMENTS

CH 688 498 A 10/1997
CH 691 711 A 9/2001
JP 61111485 A * 5/1986

OTHER PUBLICATIONS

European Search Report completed Jun. 13, 2003 in corresponding EP 02 07 8576.

* cited by examiner

*Primary Examiner*—Kamand Cuneo
*Assistant Examiner*—Thanh S Phan
(74) *Attorney, Agent, or Firm*—Griffin & Szipl, P.C.

(57) ABSTRACT

The timepiece, which is preferably a wristwatch, includes for each time position a capacitive sensor (C1 to C12), on a fixed bezel, including only four markings (R3, R6, R9, R12) at 3 o'clock, 6 o'clock, 9 o'clock and 12 o'clock, and a single crown-push-button (9). The case contains, in particular, a non-acoustic vibration generator (20) and an electronic interpretation and coding circuit (15), associated with a time-keeper circuit (10), with the sensors and with the crown to control the vibration device, said circuit (15) being designed to identify the manipulations on the crown (brief, long application of pressure or pull) and on the sensors (positioning or movement).

15 Claims, 3 Drawing Sheets

TIMEPIECE WITH TOUCH-TYPE READING AND CONTROL OF TIME DATA

This application claims priority from European Patent Application No. 02078576.2, filed Aug. 30, 2002, the entire disclosure of which is incorporated herein by reference.

BACKGROUND OF THE INVENTION

The present invention concerns a timepiece with touch-type reading and control of time data. The invention more particularly concerns a wristwatch enabling a user paying average attention, in conditions in which he does not want to or cannot look at the dial, without any acoustic signal perceptible to the persons near him, to find out the current time or be informed of an alarm time that can also be chosen, activated or deactivated without any visual check. This is the case, for example, of a user in conditions of reduced visibility, for example at nightfall, or a user with a visual handicap, or even a blind user.

The principle of such a wristwatch, whose external appearance in no way differs from other wristwatches in which the time can be read solely visually, is already known for example from U.S. Pat. No. 5,559,761. According to this principle, capacitive, inductive or other sensors are arranged on the periphery of the glass and each sensor is individually activated by the presence of a finger triggering a vibrating device, which delivers trains of non-acoustic vibrations representative of time data or an operating mode. The vibrating device used is for example that described in U.S. Pat. No. 5,365,497. In practice, after a certain number of more or less complex manipulations on the push-buttons or crown, by short or long applications of pressure, pulling or successively combining several operations, the user follows the periphery of the glass with his finger or positions it on a single sensor until vibrations can be felt on his finger or his wrist. In order to determine the detected or selected position, he has to return his finger to the bezel, which includes as many raised or sunk markings as sensors, then count the number of positions separating it from the crown forming the basic reference. In order to facilitate determination of a position, U.S. Pat. No. 6,052,339 proposes having markings for all the sensors, carried by the bezel extending beyond the latter such that the user can also follow the edge of the middle part with his finger.

Despite these improvements, wristwatches corresponding to the aforecited prior art still have debatable aesthetic appearance, and, especially, require non-negligible learning in order to "read" the time or control a time function. According to the description of U.S. Pat. No. 6,052,339, in order to change the alarm time, a short application of pressure has to be made on the crown, the sensor at 6 o'clock has to be briefly touched, the crown has to be pulled before finally being able to select a new alarm time.

It is thus an object of the present invention to make the manipulations that have to be carried out to read or control time data in a touch-type manner much more simple, and especially to make these manipulations very easy to memorise for a user with an average attention span.

SUMMARY OF THE INVENTION

The invention therefore concerns a timepiece with analogue display via hands, and more particularly a wristwatch of normal appearance comprising only one crown-push-button on the middle part. The case closed by a glass surrounded by a fixed bezel contains, in the space delimited by the dial and the back cover:

a timekeeping circuit;

at least one stepping motor for driving each hand individually;

a non-acoustic vibration generator;

at least one energy source for the timekeeping circuit, the stepping motors and the vibration generator device;

a set of twelve sensors arranged on the periphery of the glass facing twelve time positions, and an electronic interpretation and coding circuit associated with the timekeeping circuit and receiving from the sensors and the crown signals for driving the vibration generator device.

This timepiece is characterised in that the bezel includes only four markings at the 3 o'clock, 6 o'clock , 9 o'clock and 12 o'clock time positions and in that the electronic circuit is designed to recognise both a specific manipulation of the crown-push-button (brief or long application of pressure; pulling), activation of an individual sensor, of any sensor in a group of contiguous sensors, as well as the clockwise or anti-clockwise direction of activation of contiguous sensors. This design has the advantage, as will be seen hereinafter, of omitting counting the number of markings with respect to the crown, and reducing to two the number of manipulations that have to be carried out before acting on the sensors.

Other features and advantages of the invention will appear more clearly upon reading the following detailed description, made with reference to the annexed drawings, in which:

DETAILED DESCRIPTION OF THE PREFERRED EMBODIMENTS

Figure 1:
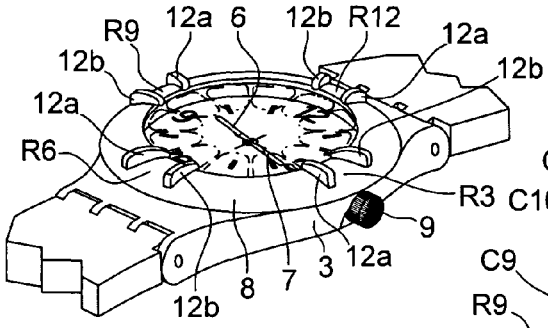
FIGS. 1 and 2 show a first embodiment and operating mode.
Figure 2:
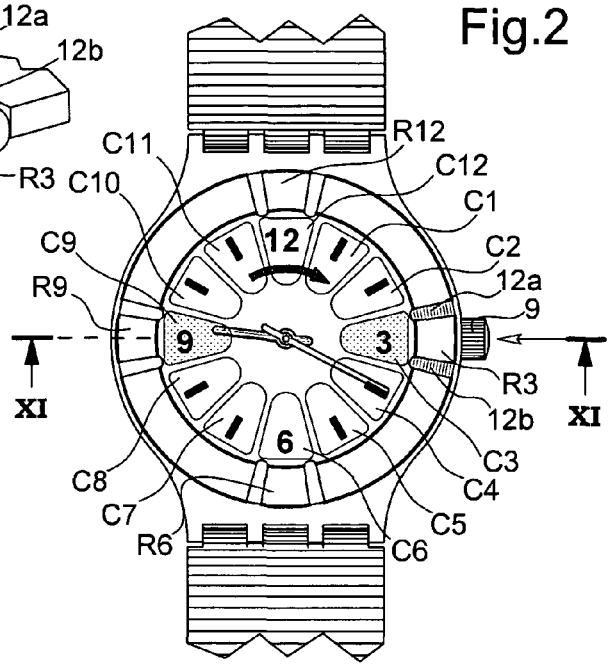
Figure 11:
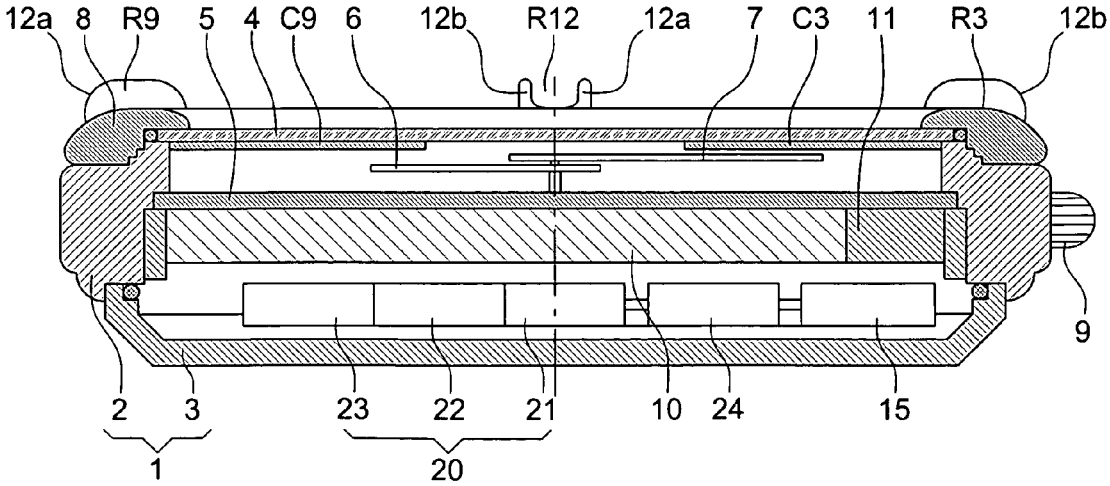
FIG. 11 shows a diametral cross-section of the wristwatch shown in FIG. 2, along the line XI—XI.

With reference first of all to FIGS. 1, 2 and 11, it can be seen that the wristwatch shown includes a case 1 formed by a middle part 3 closed in a waterproof manner, at its base by a back cover 2, and at its top part by a glass 4 arranged above dial 5 comprising an analogue display by means of an hour hand 6 and a minute hand 7. Given that the watch that will be described also enables the time to be read entirely normally in a visual manner, the display could also include a second hand. The top part of middle part 2 carries a fixed bezel 8 helping to ensure sealing in the glass-middle part region. A crown-push-button 9, on which it is possible to exert either a brief or long application of pressure, or pull, is positioned on the middle part at 2 or 3 o'clock. A brief application of pressure is pressure exerted for example for less than 2 seconds, and a long application for more than 2 seconds. In the schematic cross-section of FIG. 11, where the assembling means are not shown since they are well known to those skilled in the art, it can be seen that the space delimited by case 1 and dial 5 is occupied by a horometric movement schematically represented by a time-keeper circuit 10, a stepping motor 11, a vibrating device 20, and an electronic interpretation and coding circuit 15, all of it being powered by an energy source 24.

Vibrating device 20 is for example that described in the aforecited U.S. Pat. No. 5,365,497. It is basically formed of an electromagnetic motor 21 capable of transmitting an oscillating movement to a weight 23 via a resilient connection 22. The vibration, or train of vibrations, thereby created can be felt at any location on the case and on the user's wrist in the case of a wristwatch taken by way of illustration in this description. The coding of the vibrations or trains of vibrations is substantially the same as that disclosed in U.S. Pat. No. 6,052,339. The wristwatch according to the invention obviously allows the time to be read usually in a visual manner, but also in a "touch-type" manner by means of twelve capacitive sensors C1 to C12 arranged underneath the glass above each time marking, said sensors being electrically connected to electronic interpretation and coding circuit 15 which is designed to distinguish the position of a finger immobile on a single sensor, or a sensor belonging to a group of sensors, from a finger brushing over successive sensors in the clockwise or anticlockwise direction. As will be seen hereinafter, this peculiarity of the electronic circuit makes touch-type reading of the time data particularly easy. In order to distinguish the clockwise/anticlockwise direction, the circuit proposed in U.S. Pat. No. 4,369,440 will for example be used in electronic circuit 15, but other types of circuit can also be used.

The position of each sensor, designated generally by Ci, is identified owing to bezel 8 that includes four markings R3, R6, R9 and R12 located at the four time positions 3 o'clock, 6 o'clock, 9 o'clock and 12 o'clock . In this first embodiment, each marking is formed by two bars 12*a*, 12*b* in a raised position on the bezel and being spaced at the same distance as the width of the sensor associated with the edge of glass 4. Thus, for example, the user who detects vibrations, with his finger, which he has unknowingly passed over the glass above sensor C3, immediately identifies marking R3 as a result of the two bars 12*a*, 12*b* which he feels with his finger on the inner edge of bezel 8, this identification being able to be achieved without any risk of confusion with the bars of the three other markings which are sufficiently far away spatially. The user then knows that his finger was on the 3 o'clock time position. Conversely, if he wishes to select this 3 o'clock time position, he can easily identify bars 12*a*, 12*b* of marking R3 and slide his finger over the glass on sensor C3.

If, for example, around the 3 o'clock time position, after having felt vibrations, he can only feel a single bar that is blocking the movement of his finger in the clockwise direction, he knows that he is before marking R3 and that the sensor that has delivered vibrations is sensor C2, thus corresponding to the 2 o'clock time position.

Conversely, if after having felt vibrations, he can only feel a single bar blocking the movement of his finger in the anticlockwise direction, he knows that he has gone past marking R3 and that the sensor that has delivered vibrations is sensor C4 corresponding to the 4 o'clock time position.

As previously indicated for the 3 o'clock time position, the user can carry out the operation in reverse and easily select the 2 o'clock or 4 o'clock time positions and act in the same way for any of the three markings. Thus, with only four markings each associated with three time positions, the user can without any difficulty or ambiguity find or select any time position.

FIG. 2 will now allow us to understand the operation of a wristwatch according to the invention in "current time reading mode" shown by way of example to be 9h19. A brief application of pressure is first of all exerted on crown 9 to pass into touch-type mode. As will be seen hereinafter, other manipulations, long application of pressure or pull, also cause one to pass into touch-type mode. The touch-type mode only lasts for a limited period of time. If the manipulations on the sensors are interrupted, for example for more than 10 s the tactile mode is interrupted, this duration being reinitialised at each new manipulation. This design has the advantage of increasing the lifetime of the energy source, generally formed by a battery, while allowing the user all the time necessary to find out, in this case, the time, or to check the time data that he has detected.

Thus, after having exerted a brief application of pressure, he runs his finger around the edge of the glass in the clockwise direction, which can be detected, as indicated previously, by electronic circuit 15 to pass into "current time reading mode". It will be observed that this manipulation is easy to memorise since this direction corresponds to the natural rotational direction of the hands. Assuming that he has started to brush against the edge of the glass from 6 o'clock, he will feel a continuous vibration coding the hours when his finger is above sensor C9, a position that he will easily identify as 9 o'clock thanks to marking R9. By continuing to brush against the edge of the glass, his finger will be positioned on sensor C3 where he will feel, in a repeated manner, countable trains of vibrations, coding the minutes (1 to 4 minutes) to add to the detected time position, each vibration train being separated by longer pauses. Thanks to marking R3, the user knows that he is on the 3 o'clock time position, i.e. 15 minutes, to which he adds the 4 vibrations that he can count in each train of vibrations, i.e. altogether 19 minutes.

By way of example, each vibration has a duration of 125 ms, separated from the following vibration by a pause of 375 ms, each train of vibrations being separated from the next by a longer pause of 875 ms.

Assuming that the minute hand had been at exactly 15 minutes, the user would have felt a train of uncountable vibrations, i.e. vibrations separated by pauses too short to enable them be counted. Lastly, when the two hands are superposed, the hour and minute coding are successive.

Figure 3:
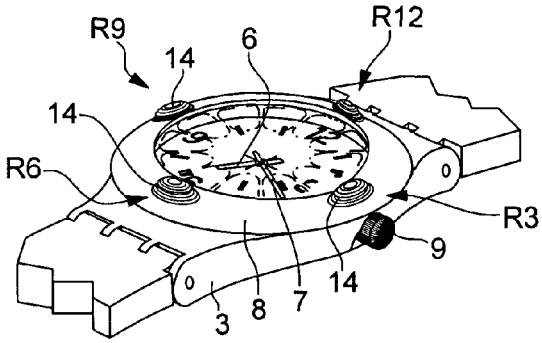
FIGS. 3 and 4 show a second embodiment and operating mode.
Figure 4:
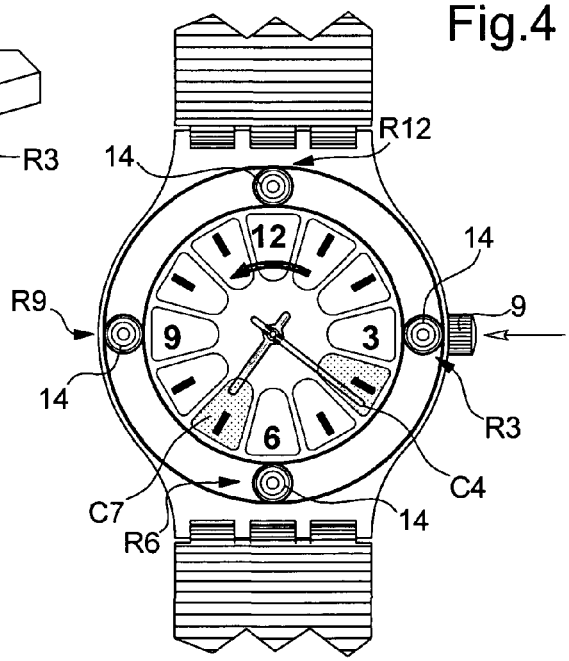

With reference now to FIGS. 3 and 4, a second embodiment, and the operation of the wristwatch in an "alarm time reading mode" will be described hereinafter.

In FIG. 3, it can be seen that the four markings R3, R6, R9 and R12 are formed by projections 14, allowing sensors C1 to C12 to be easily identified in the same way as previously indicated. Equally, these projection 14 with smooth transition to the bezel could be replaced by geometric shapes having transitions with sharper angles to the bezel.

FIG. 4 schematically shows how to read the alarm time, or more exactly how to check an alarm time that has, for example, been set at 07.22, but which has been forgotten. After having exerted a brief application of pressure on the crown, the user runs his finger over the edge of the glass anticlockwise, a manipulation that he can easily memorise as being the opposite manipulation to that carried out to read the current time. This manipulation brings the hands into the position of the last alarm time set. If the user can look at his watch he can remove his finger without waiting for the vibration train coding. If not, reading is carried out in the same way as before. When the user's finger reaches sensor C7, he feels a continuous vibration which codes 7 o'clock, and when his finger reaches sensor C4 he feels trains of two vibrations to be added to the 20 minutes corresponding to the 4 o'clock time position. Given that there is no risk of confusion between the hour coding and the minute coding, it will be noted that the order in which the hour sensor (Ch) and the minute sensor (Cm) are detected is of no importance. This is also true for reading the current time as previously described.

Figure 5:
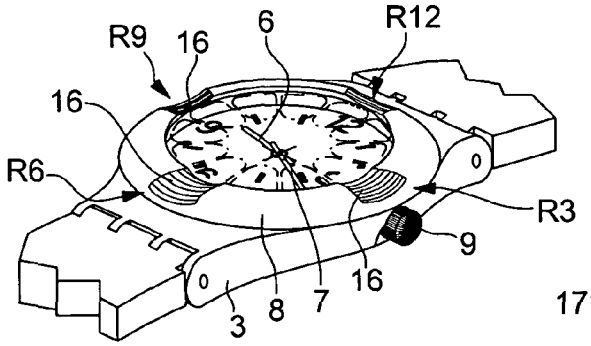
FIGS. 5 and 6 show a third embodiment and operating mode.

FIG. 5 shows a third embodiment in which the four markings R3, R6, R9 and R12 are formed by recessed portions 16 in the bezel, as previously contributing to easy identification of the time positions.

Figure 6:
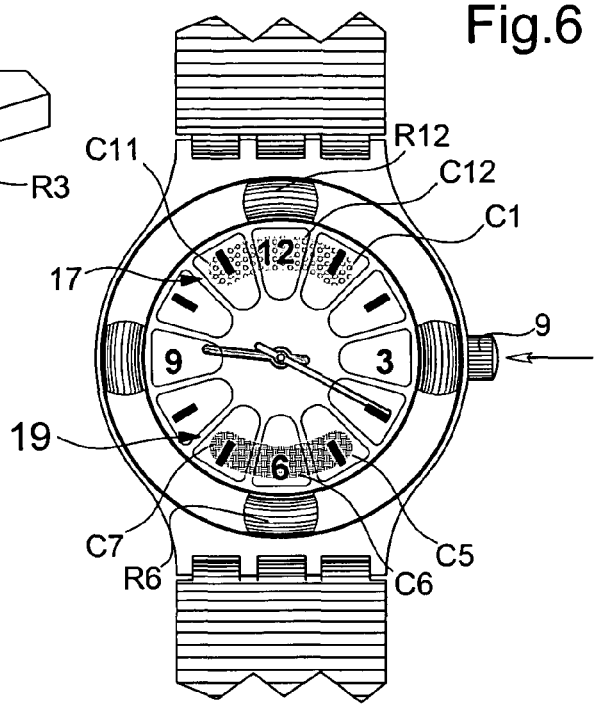

FIG. 6 schematically shows how to switch the alarm on (ON) and off (OFF).

FIG. 6 shows two bean shaped zones covering three consecutive sensors Ci, Ci+1, Ci+2 namely sensors C11, C12 and C1 for zone 17 corresponding to the ON state and sensors C5, C6 and C7 for zone 19 corresponding to the OFF state.

In order to switch the alarm to the ON state, the user exerts a brief application of pressure on crown 9 then puts his finger in zone 17, easily identified by marking R12 and holds it without moving in this position. The watch then emits two vibrations indicating that this state has been stored. Likewise, in order to switch the alarm to the OFF state he carries out the same manipulation by positioning his finger on zone 19 at marking R6 and holds it in this position without moving. The watch then emits a single vibration indicating that this state has been stored.

The vibrations acknowledging the ON/OFF state can be confirmed by the alarm vibration if the user holds his finger on zone 17 or 19 for a sufficiently long time, for example more than 7 seconds. This also constitutes a "demonstration" mode in a sales point to show the touch operation of the watch, without loosing the set time.

It will be observed that the user does not need to be very careful since the three sensors of each zone fulfil exactly the same function.

Figure 7:
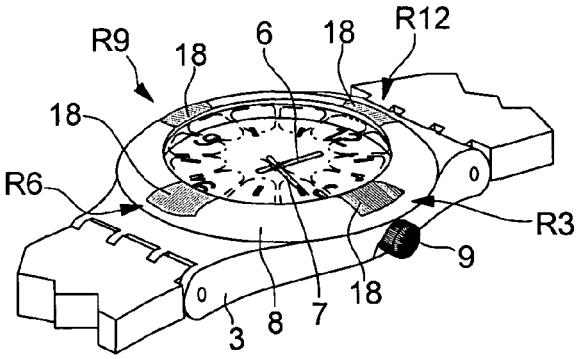
FIGS. 7 and 8 show a fourth embodiment and operating mode.

FIG. 7 shows a fourth embodiment wherein the four markings R3, R6, R9 and R12 are formed by rough surfaces 18 on the bezel. This embodiment may be advantageous for aesthetic reasons. It is in fact possible, for example by engraving guilloché patterns, to give a uniform visual appearance to the whole bezel by covering the spaces between the markings with a smooth resin.

Figure 8:
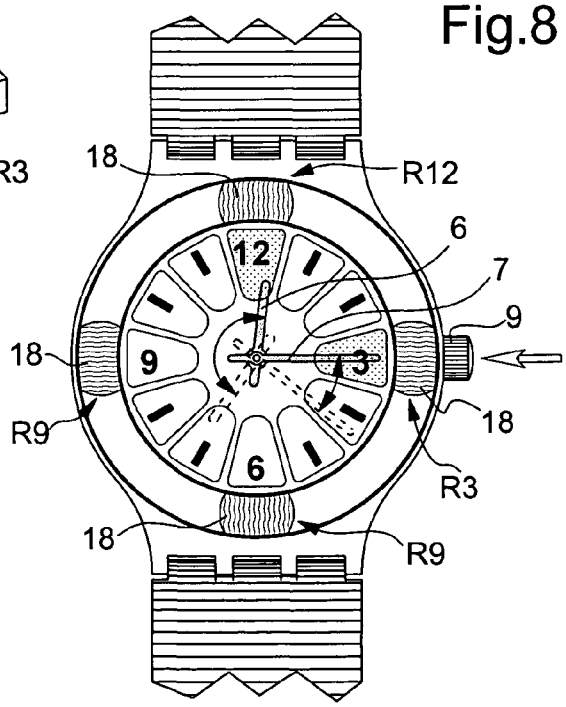

In the two preceding examples, we saw how to check an alarm time and how to switch it to the ON or OFF state. With reference to schematic FIG. 8 we will now explain how to change the alarm time from 07.22 to 12.15. In order to do this, the user first of all exerts a long application of pressure on crown 9, for example comprised between 2 and 10 seconds. He selects marking R12 on the bezel corresponding to the 12 o'clock position and slides his finger over the glass: hour hand 6 moves towards this position and the user feels a continuous vibration. After removing his finger, he selects marking R3 corresponding to 15 minutes in the same way: minute hand 7 moves to this position and the user feels a train of three uncountable vibrations. The user then has to remove his finger and the alarm is set at the selected time in the ON state. If the user keeps his finger on sensor R3, he will feel, after a long pause, for example of one second, a new vibration indicating that the alarm time is now set at 12.16, and so on until 12.19.

Figure 9A:
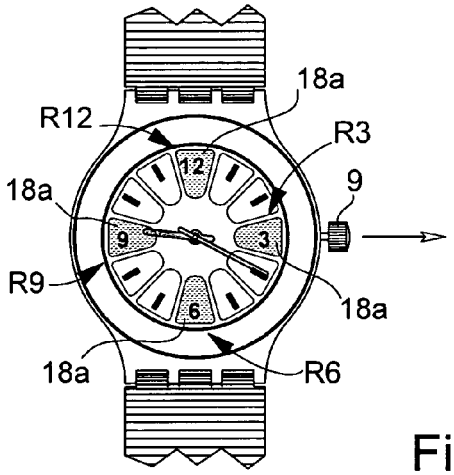
FIGS. 9A, 9B show a fifth embodiment and operating mode.
Figure 9B:
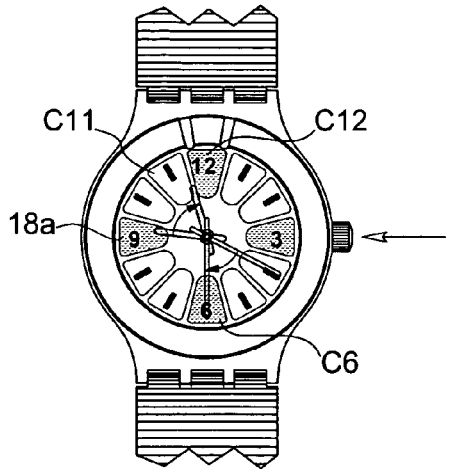

The schematic diagrams of FIGS. 9A, 9B show a fifth embodiment and explain how, without looking at the dial, a user can also set his watch to the correct time from a "beep" delivered by a radio or speaking clock. This fifth embodiment in fact forms a variant of the preceding embodiment. In fact, the markings R3, R6, R9 and R12 are added to glass 4, which can easily be achieved by known techniques, practically invisible to the naked eye.

First of all, the user pulls crown 9 (FIG. 9A), which corresponds to the usual manipulation on most watches for setting the time. He then selects, according to the mode previously indicated for changing the alarm time, a time close to the next "beep". When he hears the beep, he presses on the crown again.

Figure 10:
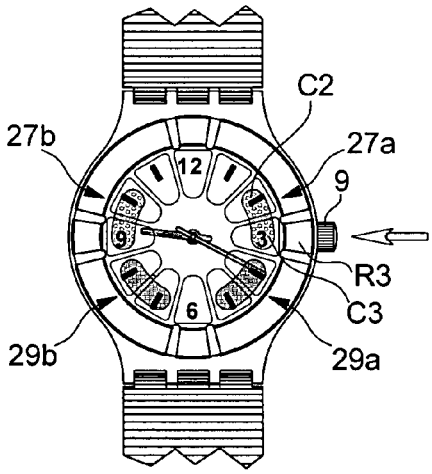
FIG. 10 shows a last operating mode.

When the wristwatch includes a stepping motor, the hands may be offset with respect to the time reference located at 12 o'clock. FIG. 10 schematically shows that it is also possible to carry out this initialisation by superposing hands 6, 7 perfectly at 12 o'clock. This relatively rare manipulation has to be carried out with visual checking. In order to do this, the user exerts a long application of pressure on crown 9 then places his finger on any one of the two zones 27*a* or 27*b* formed of two sensors, respectively located close to marking R3 for sensors C2 and C3 and close to marking R9 for sensors C9 and C10: the hour hands is positioned at 12 o'clock. These two zones simply allow the rotational direction of the hand, in the clockwise direction for zone 27*a* and the anti-clockwise direction for zone 27*b*. Their position is also provided such that a finger placed on one of these zones does not mask the time reference at 12 o'clock. He acts in the same way with zones 29*a*, 29*b* corresponding respectively to sensors C4, C5 and C7, C8 to bring minute hand 7 into perfect superposition with hour hand 6. During these manipulations, the counters of the watch movement continue to be incremented, such that after the 10 second "time-out" hands 6, 7 return to the position indicating the precise time, without any angular shift. As for switching the alarm function ON/OFF, the presence of two sensors fulfilling the same function in the same zone, is convenient for the user by requiring less attention from him than for reading the current time or alarm time.

The composition of zones 17, 19, 27*a*, 27*b*, 29*a*, 29*b* and their position have only been given in this description by way of example, and it is clear that those skilled in the art can make modifications without departing from the scope of the present invention.

What is claimed is:

1. A timepiece with touch reading and control of time data including:

a case formed of a back cover and a middle part closed by a glass arranged above a dial with analogue display including hands, said glass being surrounded by a fixed bezel mounted on the middle part including a crown-push-button;

a timekeeping circuit disposed in the case;

at least one stepping motor for driving each hand individually;

a non-acoustic vibration generator;

at least one energy source connected to power the timekeeping circuit, the stepping motors and the vibration generator device;

a set of twelve sensors arranged on the periphery of the glass facing twelve time positions and over which a finger has to run; and an electronic interpretation and coding circuit associated with the timekeeping circuit and connected to receive, from the sensors and the crown-push-button, signals for driving the vibration generator, wherein the bezel is provided with only four markings, identifiable by feel, arranged facing the four 3 o'clock, 6 o'clock, 9 o'clock, and 12 o'clock time positions, wherein the electronic circuit recognises and differentiates a brief application of pressure from a long application of pressure on the crown-push-button, recognises the activation of any individual sensor in a group of contiguous sensors, and recognises the clockwise or anti-clockwise direction in which contiguous sensors are activated.

2. The timepiece according to claim 1, wherein each marking is formed of two bars projecting from the bezel and arranged on both sides of a sensor corresponding to the 3 o'clock, 6 o'clock, 9 o'clock, 12 o'clock time positions.

3. The timepiece according to claim 1, wherein each marking is formed of a projection projecting from the bezel by a sensor corresponding to the 3 o'clock, 6 o'clock, 9 o'clock, 12 o'clock time positions.

4. The timepiece according to claim 1, wherein each marking is formed by a recess arranged in the bezel by a sensor corresponding to the 3 o'clock, 6 o'clock, 9 o'clock, 12 o'clock time positions.

5. The timepiece according to claim 1, wherein each marking is formed by a rough surface arranged on the bezel by a sensor corresponding to the 3 o'clock, 6 o'clock, 9 o'clock, 12 o'clock time positions.

6. The timepiece according to claim 1, wherein each marking is formed of a rough surface on the glass by a sensor corresponding to the 3 o'clock, 6 o'clock, 9 o'clock, 12 o'clock time positions.

7. The timepiece according to claim 1, wherein the sensors are of the capacitive type and are located under the glass above each time position.

8. The timepiece according to claim 1, wherein said timepiece is a wristwatch.

9. The timepiece according to claim 1, wherein the clockwise direction causes the electronic circuit to pass into current time read mode and the anti-clockwise direction into alarm time read mode, by activating two sensors, whose signals trigger trains of vibrations coding respectively the hour and the minutes, the time position of said sensors being determined by bringing the finger back onto the bezel to identify, either one of the four markings, or an immediately preceding position, or an immediately following position.

10. The timepiece according to claim 1, wherein a brief application of pressure associated with an immobile positioning of the finger on a first sensor of the group of sensors at 11 o'clock, 12 o'clock, and 1 o'clock positions corresponds to the position of the alarm when ON and associated with an immobile positioning of the finger on a second sensor of the group of sensors at the 5 o'clock, 6 o'clock, and 7 o'clock positions to the position of the alarm when OFF.

11. The timepiece according to claim 1, wherein a long application of pressure successively associated with two sensors allows an alarm time to be selected.

12. The timepiece according to claim 1, wherein the electronic circuit recognises a pull exerted on the crown-push-button associated with the positioning of the finger successively on a sensor or on two sensors for changing time zone or for changing the current time.

13. The timepiece according to claim 1, wherein each hand is driven separately by a stepping motor and in that the electronic circuit recognises a long application of pressure exerted on the crown-push-button associated with a group of sensors positioned at 2 o'clock, 3 o'clock or 9 o'clock, 10 o'clock, or associated with a group of sensors positioned at 4 o'clock, 5 o'clock or 7 o'clock, 8 o'clock, to successively bring the hands into superposition at the 12 o'clock position to initialise the display.

14. The timepiece according to claim 1, wherein brief application of pressure is pressure exerted for less than 2 seconds and long application of pressure is pressure exerted for more than 2 seconds.

15. A timepiece with touch reading and control of time data including:

a case formed of a back cover and a middle part closed by a glass arranged above a dial with analogue display including hands, said glass being surrounded by a fixed bezel mounted on the middle part including only one crown-push-button;

a timekeeping circuit disposed in the case;

at least one stepping motor for driving each hand individually;

a non-acoustic vibration generator;

at least one energy source connected to power the timekeeping circuit, the stepping motors and the vibration generator device;

a set of twelve sensors arranged on the periphery of the glass facing twelve time positions and over which a finger has to run; and an electronic interpretation and coding circuit associated with the timekeeping circuit and connected to receive, from the sensors and the crown-push-button, signals for driving the vibration generator, wherein the bezel is provided with only four markings, identifiable by feel, arranged facing the four 3 o'clock, 6 o'clock, 9 o'clock, and 12 o'clock time positions, wherein the electronic circuit operates to recognise and differentiate a brief application of pressure from a long application of pressure on the crown-push-button, to recognise the activation of any individual sensor in a group of contiguous sensors, and to recognise the clockwise or anti-clockwise direction in which contiguous sensors are activated.

* * * * *